United States Patent [19]

Garner et al.

[11] 4,426,838

[45] Jan. 24, 1984

[54] APPARATUS FOR STRANDING WIRES

[75] Inventors: John N. Garner, Kingston; Jean M. Roberge, Pointe Claire; Norbert J. Meilenner, St. Catharines, all of Canada

[73] Assignee: Northern Telecom Limited, Montreal, Canada

[21] Appl. No.: 413,178

[22] Filed: Aug. 30, 1982

[51] Int. Cl.[3] ..... H01B 13/04

[52] U.S. Cl. ..... 57/293; 57/13; 57/344

[58] Field of Search ..... 57/6, 13, 15, 293, 294, 57/314, 344

[56] References Cited

U.S. PATENT DOCUMENTS

| | | | |
|---|---|---|---|
| 3,847,190 | 11/1974 | Forester | 57/293 X |
| 3,910,022 | 10/1975 | Reed | 57/293 |
| 4,325,214 | 4/1982 | Zuber | 57/344 X |
| 4,359,860 | 11/1982 | Schleese et al. | 57/293 |

*Primary Examiner*—John Petrakes
*Attorney, Agent, or Firm*—R. J. Austin

[57] ABSTRACT

Wire stranding apparatus having elongate wire guide means which is rotationally flexible about its axis and defines individual feed paths for the wires with means to prevent rotation of the guide means at its upstream end and a twisting means to cause torsional twisting of the guide means in alternate directions at the downstream end. Direction changing means is provided to change direction of twist after a predetermined amount of twist in each direction. The changing means includes a trigger device (e.g. an arm) secured to the guide means towards its upstream end and initiating means which senses the position of the trigger device after the predetermined twist in the guide means to initiate the change in direction of drive. The upstream position of the trigger device gives it small rotational movement around the guide means compared to the rotational movement of the downstream end of the guide means.

17 Claims, 7 Drawing Figures

APPARATUS FOR STRANDING WIRES

This invention relates to apparatus for stranding wires.

It is known that the stranding of wires together to form a wire unit offers physical and electrical advantages when used in communications or other electrical systems. For example, stranding of pairs or units of wires as used in telephone systems improves electrical characteristics, such as reducing crosstalk.

Conventionally, to continuously strand wires together in the same direction requires a heavy movable construction as the wire spools for feeding wire into the apparatus must also resolve about the machine axis. The heavy construction limits the operational speed. To avoid the rotation of the spools, a periodically reversing twist is given to the wires and as it is desirable to twist long lengths of wires, accumulators become necessary.

In order to overcome problems with known stranding apparatus, simpler apparatus has been devised to give a periodic reverse twisting operation. This simpler apparatus, as described in U.S. Pat. No. 3,910,022 granted Oct. 7, 1975 in the name of Phillip John Reed and entitled "Apparatus For Stranding Wire", involves the use of a tubular member one end of which is held stationary and the other twisted first in one direction and then the other. Dividers positioned along the tube form separate paths for wires passing down the tube and a twisting means at a tube outlet places the reverse twist in the wires.

The above apparatus had certain disadvantages which were overcome by apparatus described U.S. Pat. No. 4,325,214 granted Apr. 20, 1982 in the name of Bretislav Pavel Zuber and entitled "Apparatus For Stranding Wire". In this patent, the tubular member is replaced by an elongate member which is held stationary at an upstream end and is rotatable at its downstream end for twisting it, the elongate member having a plurality of wire guiding elements extending radially outwards from it and the elements having wire guiding holes whereby the wires are threaded through the holes from guiding element to guiding element while being located outwards from the elongate member.

In both the Reed and Zuber apparatus discussed above, a rotating means is included for the downstream end of the elongate member. Clearly, for the elongate member to be rotated, alternately, in one direction and then the other, some reversing means has to be included. In the Reed and Zuber apparatus, such reversing means is located at the downstream end of the elongate member and includes two clutches surrounding the elongate member and mounted upon a hollow shaft. This shaft is rotatable with the downstream end of the member and has a screw threaded outside surface along which a nut is movable in one direction or the other dependent upon the direction of rotation of the elongate member and shaft. The nut reaches extreme axial positions of movement after predetermined oscillations of the elongate member and in each of these positions, it causes the actuation of a limit switch which controls the operation of one clutch or the other to change the direction of rotation of the elongate member. While this reversal system operates successfully, the rotating parts upon the elongate member add to the inertia of the system and it is necessary for this inertia to be overcome upon each change in direction of the elongate member. In such apparatus where it is important to reverse the rotational direction in the minimum time to restrict the lengths of wire which extend between changeover positions from one direction of twist to the other, obviously, such inertial forces operate against the best use of the apparatus.

The present invention is concerned with an apparatus for stranding wires and including a direction changing means in which the rotatable parts may have a mass exceedingly smaller than that of the previous apparatus whereby a more rapid reversal in rotational direction is more quickly achieved.

According to the present invention, there is provided an apparatus for stranding wires comprising an elongate guide means having a longitudinal axis and being rotationally flexible about said axis, and defining individual feed paths for the wires along the guide means, holding means to hold the guide means against rotation about said axis at an upstream position of the guide means, wire twisting means at a downstream position of the guide means to torsionally twist the wires, the twisting means rotatable with a downstream part of the guide means, said feed paths extending through the twisting means, rotating means for rotating the twisting means together with the downstream part of the guide means for a predetermined number of revolutions about the axis alternately in one direction and then the other, direction changing means to change the direction of rotation of the twisting means after the twisting means has rotated the predetermined number of revolutions in each direction, said changing means comprising a trigger device secured to the guide means upstream of the wire twisting means to rotate with the guide means and execute a determined angular movement in each direction which is indicative of the rotation of the twisting means for said predetermined number of revolutions in the same direction, and initiating means, sensitive to the position of the trigger device upon completing its determined angular movement in each direction, to initiate said change in direction of the drive.

With the above apparatus, the trigger device itself rotates with the guide means whereas with the previous apparatus, the nut formed the trigger device and this moved axially by use of the screw-threaded shaft. Thus, with the apparatus of the invention, the trigger device in being secured to the guide means avoids the use of the screw-threaded shaft together with its inertial problems. The trigger device may have quite small mass and may be merely in the form of an arm, the position of which causes operation of the initiating means.

In order to minimize, as far as possible, the effects of inertia caused by the rotatable parts, the direction changing means is disposed upstream of the twisting means, as defined according to the invention above, whereby the angular movement and rotational speed of the trigger device is significantly less than that of the twisting means. Reduction of the rotational speed of the trigger device because of its position upstream restricts its moment of momentum.

The direction changing means may comprise a photoelectric cell device or magnetic device for determining when the trigger device passes a certain position during its rotation and revolution counter may be included to count the number of revolutions of the trigger device which correspond to the predetermined number of revolutions of the twisting means. However, such an arrangement produces possible problems in that the counter may cease to function correctly. To enable the changing means to be simplified as much as possible by eliminating such things as revolution counters, its operation should be such that upon being located sufficiently far upstream to enable the trigger device to rotate less than one complete revolution in each direction for the predetermined number of revolutions of the twisting means, the initiating means will be caused to initiate the change in direction of the drive. In this type of arrangement, the initiating means preferably comprises an electrical or mechanical switch means disposed adjacent to the guide means and the trigger device comprises at least one switch actuator arm or a magnetic field interrupter arm. Where the switch means comprises two switches relatively angularly disposed around the guide member, the actuator arm or magnetic field interrupter actuates one switch or the other after completing less than one revolution to change the direction of drive of the twisting means.

It is possible that after a period of use, a certain slackness may become apparent in the guide means. This is particularly the case where the guide means comprises a cable as described in the above-mentioned patent to Zuber. To prevent such slackness from interfering with the operation of the direction changing means, it is advisable to maintain the upstream end of the guide means in tension, i.e. between the direction changing means and the holding means while maintaining the relative operative positions of the trigger device and the initiating means. In a simple method of effecting this, the trigger device and the guide means are rotatably mounted upon a support which also fixedly carries the initiating means and means is provided to prevent rotation of the support around the guide means and to urge the support and the holding means apart to place the guide means in tension. In one arrangement, a restraining member holds the support, the restraining member extending longitudinally of the guide means in rigid fashion and at least one spring acts longitudinally to urge the support away from the holding means. The restraining member may comprise a shaft carrying a compression spring and preferably two parallel spaced shafts are provided.

Embodiments of the invention will now be described, by way of example, with reference to the accompanying drawings, in which.

Figure 4:
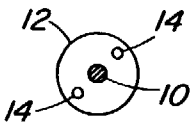
FIG. 4 is a cross-sectional view along line 'V—V' in FIG. 1 and on a larger scale.

Apparatus for stranding wire comprises a guide means incorporating an elongate member, i.e. a steel rod or cable 10 of composite plastic construction, for instance as described in above-mentioned U.S. Pat. No. 4,325,214 in the name of B.P. Zuber, which is rotationally flexible about its rotational axis. The member is held stationary at an upstream end portion by a holding means in the form of a metal clamping block 18 which is fixed to the frame 20. The cable 10 has a plurality of wire guiding elements 12 in the form of discs secured to the cable in longitudinally spaced positions. The cable 10 passes through a concentric hole in each disc and each disc is formed with guide holes 14 (FIG. 4) angularly spaced apart around the longitudinal axis, one hole 14 for each of a plurality of wires 16 which are to be stranded together. As there are two wires to be stranded, there are two holes 14 in each disc, diametrically opposed across cable 10. Guide paths are thus provided for the wires from spools 17 and through corresponding holes from one element to another.

At the downstream end of the cable 10 is provided a wire twisting means for torsionally twisting the wires. This twisting means comprises a cylinder 22 having the member 10 extending through it and secured within it by epoxy resin for instance in the manner described in the above-mentioned application to Zuber. Two holes 24 for passage of the wires also extend through the cylinder. The cylinder is rotatably mounted in the frame (not shown) and secured coaxially to the cylinder is a driven pulley wheel 26. Rotating means to drive the pulley comprises a inertia D.C. electric motor 28. The motor is reversible and is of a type known as "pancake" motor such as sold by Mavilor Motors, Hartford, Connecticutt, under model no. MOA-600. It is imperative that the reversing time of the motor is as short as possible to restrict the lengths of stranded wire which extend between changeover positions from one direction of twist to the other. In this particular motor, it is estimated that reversal time is about 40 to 60 miliseconds. The rotating means also includes a drive pulley wheel 30 and belt 32 by which the motor 28 is drivably connected to the pulley wheel 26.

Rotation of the cylinder 22 alternately in opposite directions, each for a predetermined number of revolutions about the axis of the cable 10 imposes torsional twist in the wires and causes them to strand together after they leave the cylinder 22 in the manner described in the aforementioned application to Zuber.

The present invention is concerned with apparatus for stranding wires and having a direction changing means for the rotating means by which the inertia and movement of momentum is significantly reduced as compared to the apparatus described in the U.S. Pat. No. 4,325,214, referred to above, which uses a screw-threaded shaft rotatable with the cable in the region of the twisting means and a nut movable by the shaft.

According to the present invention, the apparatus includes a direction changing means disposed upstream of the twisting means. This changing means, shown generally at 34, is disposed at an upstream end portion of the cable 10, i.e. upstream of the guiding elements 12.

Figure 3:
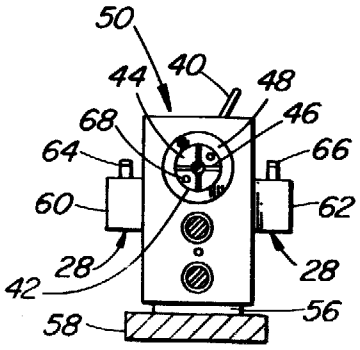
FIG. 3 is a view of the direction changing means taken along line 'III—III' in FIG. 2.
Figure 2:
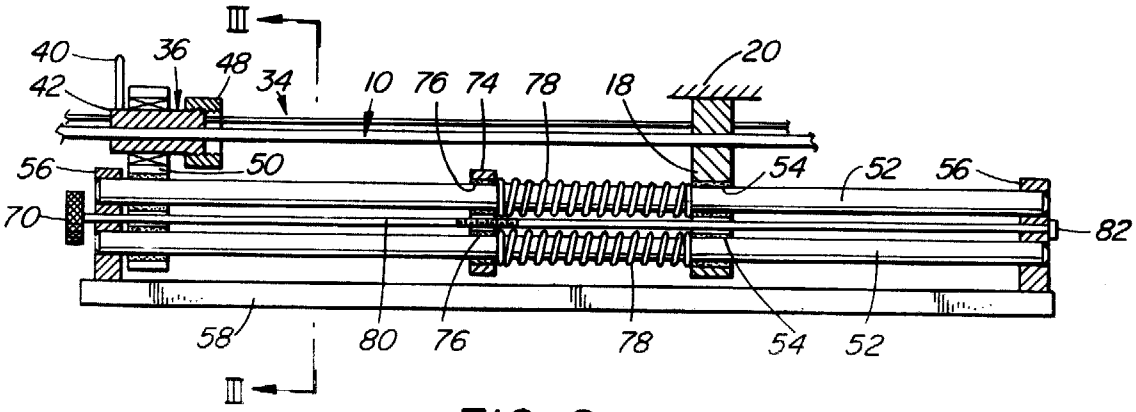
FIG. 2 is a cross-sectional view of a direction changing device taken along the axis of the apparatus and shown on a larger scale than FIG. 1.

As shown particularly by FIGS. 2 and 3, the changing means comprises a trigger device 36 and means 28 to initiate change in direction of the drive to the pulley wheel 26, i.e. by reversing direction of rotation of the D.C. motor.

The trigger device comprises a switch actuator arm 40 secured to and extending outwardly from a cylindrical clamp 42 which surrounds and tightly grips a portion of the member 10 passing through a central hole in the clamp. As shown by FIG. 3, the clamp is formed at an upstream end from segments 44 formed by radial cuts 46, and a nut 48 with tapered thread is received in screw threaded engagement with the outer surface of the segments. By virtue of the tapered thread, as the nut is tightened, the segments are forced inwards to grip the cable 10 and prevent relative rotation of clamp and member.

The clamp is rotatably mounted within a support 50 which is itself prevented from rotating about the cable 10 by virtue of the support being secured towards one end of each of two parallel and spaced shafts 52 which extend longitudinally of the cable 10 and are slidably received through holes 54 in the clamping block 18.

The shafts 52 are secured at their ends within two mountings 56, one upstream and the other downstream of the block 18, and the mountings are joined together by a longitudinally extending base 58 to which they are secured.

Clearly, the changing means 34 is held axially in position upon the cable 10 by the clamp 42 with the arm 40 and the initiating means 28 disposed only slightly downstream from the part of the cable 10 held by the block 18 which prevents rotation of the member 10 at this position. Rotation of the twisting means at the downstream end of the cable places torsional force on the member as it is rotated in each direction. By virtue of the fact that the upstream end of the cable 10 is non-rotatable, then the number of revolutions from one part of the member to another moving upstream, progressively decreases as the fixed end is approached. In fact, it is safe to assume that at a distance 'x' along the member from the block 18, the ratio of the revolutions at distance 'x' to the predetermined amount of revolutions of the twisting means is equal to the ratio of the distance 'x' to the distance from the twisting means to the block 18. Working on this consideration, for an exceedingly long length of the cable 10, it is a simple matter to position the actuator arm 40 and initiating means at a short distance from block 18 (e.g. 1 foot) and the actuator arm is rotated for less than one complete revolution together with the clamp 42 and cable at this position, while the twisting means rotates for its predetermined number of revolutions in each direction. Hence, the actuator arm may only be rotated around an angular movement of 90° or 180° dependent upon the number of predetermined revolutions required by the twisting means, and at the end of each of the angular movements, the arm will actuate the initiating means to change the rotational direction of the D.C. motor.

In this particular embodiment, as shown by FIG. 3, the initiating means comprises two limit switches 60 and 62 which are mounted upon the support 50 with switch arms 64 and 66 disposed in positions to operate the switches when the actuator arm has completed a rotational movement through an angle of up to 180°, the arms being operated one at the end of each direction of movement. The switches are connected in an electrical circuit with the D.C. motor to change its direction of rotation upon operation of the appropriate switch.

As may be seen, with the changing means mounted upon the cable 10 as shown, while the twisting means is rotating at great speed through many revolutions to impose torsional twist in the wires whereby they will be stranded together after leaving the cylinder 22, the arm 40 with the clamp 42 is rotating exceedingly slowly. Hence, at the end of the rotational movement, when the arm operates one of the limit switches to reverse the drive direction of the motor, the moment of momentum of the arm and clamp is extremely small and places an insignificant force against reversal of the twisting means. This is especially the case when it is considered that the arm and clamp are at a great distance upstream from the twisting means and, because of the torsional effect upon the cable, they can offer no serious opposition to change in rotation of the twisting means. The opposing forces are also minimized because the inertia of the arm 42 and clamp is extremely small and this factor assists the slow speed of rotation to minimize the moment of momentum.

Figure 1:
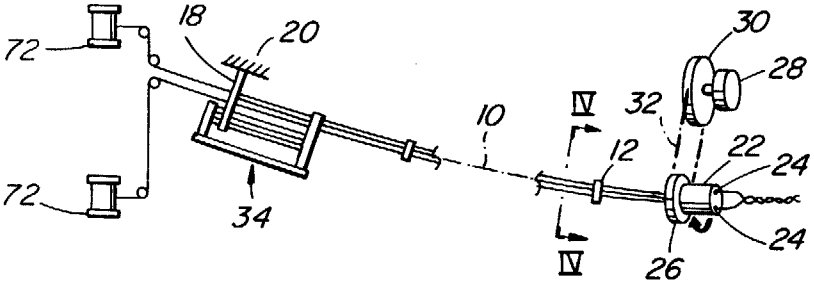
FIG. 1 is a side elevational view of apparatus according to one embodiment of the invention.

In the embodiment described, some rotational movement of the clamp 42 is necessary as it also operates as a wire guiding element with the wires passing through the holes 68 in the clamp after passing through holes in the clamping block 18 from supply reels 72 (FIG. 1).

As may be seen from this embodiment, therefore, the inertial effects upon changing the rotational direction of the twisting means are minimized whereby the changeover period is rendered as small as possible.

In addition, in the above embodiment, it is recognized that slackness in the cable 10 may develop due to stretch. This could interfere with the operation of the direction changing means unless measures are taken to prevent this. It has been found that if the cable is maintained in tension between the holding means and the support 50, while keeping the switches 60 and 62 axially fixed in relation to the support, then no difficulty occurs in operation of the changing means.

In view of the above, the present embodiment includes means for placing the cable in tension between the clamp block 18 and the support 50. This means comprises a spring abutment 74, which is effectively a nut having a screw-threaded central hole, the abutment having two holes 76 diametrically opposed across the screw-threaded hole and slidably receiving the shafts 52. Between the abutment 74 and the block 18 are located two compression springs 78, one upon each shaft 52. These springs tend to urge the abutment away from the block 18 but are held in a state of compression to maintain tension in the cable by a rotatable screw threaded spindle 80. This is in screw-threaded engagement with the abutment and has an upstream end rotatable in the upstream mounting 56 while applying the axial spring pressure upon the mounting, by a spindle head 82, to urge the whole of the changing means 34 in a downstream direction. Hence, the cable is held in tension between block 18 and the support 50 as the changing means is urged downstream under spring pressure by sliding movement of spindles 52 through the holes 54 in the block.

Means is provided to adjust the tension in the cable in the event of slack developing or increasing. This means which includes the screw-threaded spindle and the screw-threaded connection to the abutment, also includes a knob 70 at the downstream end of the spindle for manual rotation thereof. Such rotation results in corresponding movement of the abutment in the appropriate direction upon the shafts 52. However, because of the use of the springs 78, the abutment is maintained substantially in the same position relative to the block 18 while the remainder of the changing means is moved longitudinally by the spring pressure. The position of support 50 is thus changed to accommodate any slack in the cable.

The above described embodiment is basically one of the most simple constructions which could be described to illustrate the use of the apparatus according to the invention when having a cable as part of the guide means and incorporating the direction changing means. There is no reason why this invention cannot be applied to more complex constructions of apparatus. For instance, in patent application Ser. No. 413,177, filed concurrently with this present application in the names of Norbert Meilenner, Richard Sunderland and William Cook, and entitled "Apparatus for Stranding Wires", there is described apparatus having three cables operating simultaneously to strand three separate groups of wires, the groups then being brought together within one extruded insulation. In that construction, each cable is driven by its own individual D.C. motor. In that apparatus, each of the cables could also be provided with its own direction changing means mounted at an upstream end portion of the cable, each changing means being according to that included in this present invention and, perhaps, as described in the above embodiment.

Figure 5:
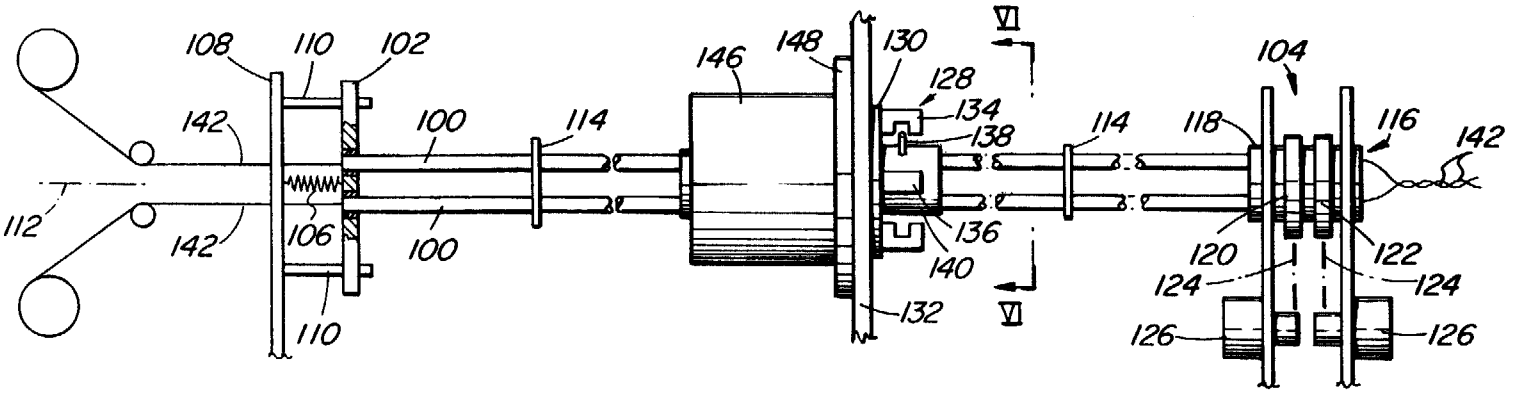
FIG. 5 is a view similar to FIG. 1 of apparatus according to a second embodiment.
Figure 7:
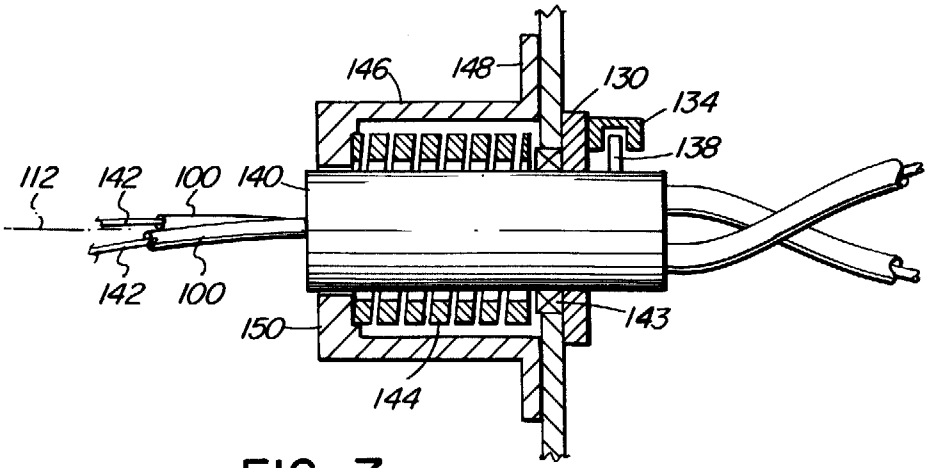
FIG. 7 is a cross-sectional view along line 'VII—VII' in FIG. 6 and showing operating parts in different relative positions from in FIG. 6.
Figure 6:
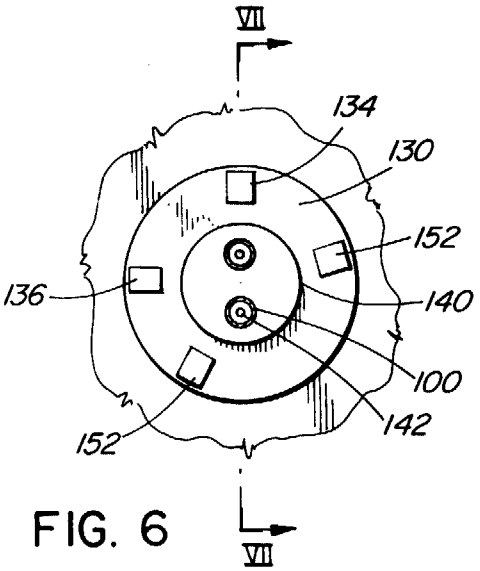
FIG. 6 is a cross-sectional view of the apparatus of FIG. 5 taken along line 'VI—VI' in FIG. 5 and on a larger scale.

In a second embodiment, as shown by FIGS. 5, 6 and 7, an apparatus for stranding wires comprises an elongate guide means, comprises two guide tubes 100 extending, one alongside the other, from a plate support 102 at their upstream ends to a twisting station 104 at their downstream ends. Each tube is individually rotatably mounted by its upstream end within the plate support which is, in turn, spring loaded by two tension springs 106 towards a fixed frame member 108, the tube support being slidable upon parallel guides 110. Only one spring 106 is shown as they are superimposed one upon the other in FIG. 5. The tubes are rotationally flexible for the purpose of withstanding torsional forces involved when the downstream ends of the tubes are rotated at the twisting station for a predetermined number of revolutions about an axis 112 of the guide means, alternately in one direction and then the other from an equilibrium position in which the tubes are untwisted and lie parallel as shown by FIG. 5. The tubes are formed from a material which provides for this rotational flexibility and may be made, for instance, from stainless steel or an acetal homopolymer, as sold under the Trademark "DELRIN". As shown, the tubes pass at intervals through discs 114 which prevent movement of the tubes apart during twisting.

The construction of the guide means, its method of mounting into the support 102 and the spring loading of the support to the frame member are described in greater detail in patent application Ser. No. 413,179, filed concurrently with this present application in the names of John Nicholas Garner, and Jean Marc Roberge and entitled "Stranding Wires".

At the twisting station, a twisting means 116 is provided, this means comprising a cylinder 118 formed with two holes within which the downstream ends of the tubes 100 are secured. Two annular electric clutches 120 and 122 have their driven sides secured to the cylinder for driving the cylinder alternately in opposite directions. Each clutch is drivable by a drive belt 124 continuously driven by an electric motor 126 forming a rotating means for rotating cylinders 118.

A direction changing means 128 is located a short distance downstream from the tube support 102, i.e. at a position in which the tubes rotate less than 360° around the axis 112 for the predetermined amount of turns at the downstream ends of the tubes. In this embodiment, the desired rotations of the downstream tube ends, as dictated by the twisting means, is thirty-five turns, alternately, in each direction from the equilibrium position shown in FIG. 5. At the position chosen for the changing means 128, each tube turns only 45° in each direction for the thirty-five rotations at their downstream ends at each side of the untwisted position shown in FIG. 5. Thus, for 70 rotations in one direction, between direction changover positions of the tube ends, each tube rotates about 90° at the changing means position.

The changing means 128 comprises an annular base plate 130 through which the tubes 100 pass, the plate being mounted upon frame member 132. A magnetic switch means comprises two 'U'-shaped heads 134 and 136 disposed 90° apart around the axis 112. In each head, one leg of the 'U' carries means for creating a magnetic field, i.e. a magnet (not shown) and the other leg houses a magnetic field strength receiving means, i.e. a coil forming part of an electric circuit which includes actuation means for alternately operating the clutches to drivably connect and disconnect the cylinder 118 with one or other of the drive belts 124.

The changing means also includes a trigger device which is a magnetic field interrupter in the form of an interrupter arm 138 for interrupting the magnetic field around each magnet, for the purpose of changing the signal received by the coil in a particular head. The interrupter arm 138 is secured to and extends outwardly from a cylinder 140 (FIGS. 5, 6 and 7) which is mounted in bearings 142 in the frame 132. The cylinder 140 is formed with two axial holes through which the tubes 100 extend. The arm 138 moves around the axis 112, during rotation of cylinder 140, between a position in which the arm lies within a gap in one of the heads 134 or 136 to a position in which it lies in the gap in the other head. With the tubes untwisted as in FIG. 5, the arm 138 lies midway between heads 134, 136.

A damping device is provided to prevent the tubes 100, at the position of the interrupter arm 138, from twisting uncontrollably because of any stored twist throughout the lengths of the tubes and which may not be dispersed in desired manner upon change in their direction of rotation. This damping device which comprises the cylinder 140, also includes a torsion spring 144 which closely surrounds the cylinder, on the upstream side of frame 132, and cylindrical surround 146. Surround 146 is secured at flange 148 to frame 132. The spring 144 is securely attached (as by braying or otherwise bonding) to the cylinder 140 at the downstream end of the spring. The upstream end of the spring is securely attached to an upstream end flange 150 of the surround 146. The twisting of the tubes 100 needs to overcome torsional resistance of the spring to enable the arm 138 to move from one head 134, 136 to the other and this creates a damping effect to ensure the arm position always corresponds to the number of twists in the downstream ends of the tubes 100.

Two safety heads 152 are provided upon the base plate 130 (see FIG. 6). These heads 152 are of the same construction as head 134 or 136, and are disposed spaced around the plate 130, each from head 134 or 136, i.e. in the 270° arc not normally travelled by the interrupter arm. In the unlikely event that the arm 138 travels through a head 134, 136 without the rotational direction of the tubes being alternated, then the arm will enter the gap in one of the heads 152 after travelling a short distance further. Interruption of the magnetic field in either head results in stopping of the electrical motors 126 whereby further twisting of the tubes, which could have resulted in damage to them, is prevented.

In use, with the tubes in the equilibrium position shown in FIG. 5, the interrupter arm 138 is centrally positioned, angularly, between the two heads 134 and 136. With one of the clutches 120 rotating the cylinder 118 and thus the downstream tube ends in one direction, the tubes at the interrupter arm position rotate slowly around the axis 112 to carry the arm towards the gap of one of the heads, e.g. head 134. Upon the downstream tube ends having completed their 35 revolutions from the equilibrium position, the arm 138 enters the gap in head 134 (as shown in FIG. 7) and interrupts the magnetic field at that head. This immediately changes the signal received by the coil in that head and a resultant electrical signal induced in the electric circuit causes disconnection of clutch 120 and connection of clutch 122 to commence turning the cylinder 118 in the opposite direction. The downstream tube ends are then turned in this opposite direction for 70 turns while the arm 138 is rotated, also in the opposite direction for 90° from the head 134. Upon the arm 138 entering the gap in the head 136, it interrupts the magnetic field at that position thereby causing an induced signal in the electric circuit to disconnect clutch 122 and connect clutch 120 once more to change the rotational direction of the tubes. The tubes then continue to be rotated in the above manner for 70 revolutions from one alternating position to the other, with directional change being effected each time the arm 138 enters a gap of one of the heads 134, 136.

The rotation of the tubes in alternating directions as described prevents the wires 142 passing down the tubes from stranding together under the twist imposed upon them by the twisting means 116. The wires may be allowed to strand together immediately they leave the cylinder 118 as shown by FIG. 5 to form a twisted pair of wires. Alternatively, the construction of the second embodiment may form a part of a larger stranding apparatus for stranding together multiple pairs of wires. In this case, a separation tube means (not shown) may be incorporated downstream of the cylinder 118 to prevent the wires from stranding together until they reach a stranding station further downstream. Such an apparatus for stranding together multiple wire pairs is described in patent application Ser. No. 413,175, filed concurrently with this present application in the names of John Nicholas Garner, Jean Marc Roberge, and Oleg Axiuk and entitled "Forming Cable Core Units".

What is claimed is:

1. Apparatus for stranding wires comprising:

a guide means having a longitudinal axis and being rotationally flexible about said axis and defining individual feed paths for the wires along the guide means;

holding means to hold the guide means against rotation about said axis at an upstream position of the guide means;

wire twisting means at a downstream position of the guide means to torsionally twist the wires, the twisting means rotatable with a downstream part of the guide means, said feed paths extending through the twisting means;

rotating means for rotating the twisting means together with the downstream part of the guide means for a predetermined number of revolutions about the axis alternately in one direction and then the other;

direction changing means to change the direction of rotation to the twisting means after the twisting means has rotated the predetermined number of revolutions in each direction, said changing means comprising a trigger device secured to the guide means upstream of the wire twisting means to rotate with the guide means and execute a determined angular movement in each direction which is indicative of the rotation of the twisting means for said predetermined number of revolutions in the same direction, and initiating means sensitive to the position of the trigger device upon completing its determined angular movement in each direction, to initiate said change in direction of the drive.

2. Apparatus according to claim 1, wherein the direction changing means is disposed upstream so that the trigger device and adjacent part of the guide means rotate less than one complete revolution for the predetermined number of revolutions of the twisting means, the initiating means comprises electrical switch means disposed adjacent to the guide means, and the trigger device comprises at least one switch actuator arm which is rotatable with the adjacent part of the guide means and actuates the switch means upon the actuator arm having completed its determined angular movement in each direction, the switch means included in an electrical circuit for determining the direction of drive for the twisting means.

3. Apparatus according to claim 1, wherein the direction changing means is disposed upstream so that the trigger and the adjacent part of the guide means rotate less than one complete revolution for the predetermined number of revolutions of the twisting means, the initiating means comprises two electrical switches disposed adjacent to the guide means and the trigger device comprises at least one switch actuator arm which is rotatable with the guide means and actuates the switches upon the actuator arm having completed its determined angular movements, one switch to each direction, the switches included in an electrical circuit for determining the direction of drive for the twisting means.

4. Apparatus according to claim 1, wherein the trigger device and guide means are rotatably mounted upon a support, the support having means to render it non-rotatable around the axis of the guide means, and means is provided to place the guide means in tension between the holding means and the support while maintaining fixed axial positions of the trigger device and initiating means.

5. Apparatus according to claim 4, wherein the means to render the support non-rotatable comprises at least one restraining member upon which the support is mounted, the restraining member extending longitudinally along and spaced from the guide means and itself being held non-rotatable relative to the holding means, the restraining member being rigid longitudinally of the guide means, and the tension means includes at least one spring acting longitudinally of the guide means to urge the support away from the holding means, the initiating means held axially fixed relative to the support.

6. Apparatus according to claim 5, including means for adjusting the position of the support away from the holding means, said adjusting means being longitudinally movable against the urgency of the spring to effect an increase in the spring urgency longitudinally against the support.

7. Apparatus according to claim 4, wherein the means to render the support non-rotatable comprises two parallel spaced shafts extending longitudinally of the guide means and mounted upon the holding means, the support carried upon the shafts, and the tension means comprises at least one compression spring acting longitudinally of the guide means to urge the support away from the holding means, the initiating means held axially fixed relative to the support.

8. Apparatus according to claim 7 wherein a spring abutment is secured upon each shaft and two compression springs are provided, one upon each shaft, one end of each compression spring acting upon its spring abutment to urge the support away from the holding means.

9. Apparatus according to claim 8, wherein the support is secured to the shafts, the shafts are slidably movable together through the holding means, and the springs are in a state of compression between the abutments and the holding means to urge the abutments and support away from the holding means by sliding movement of the shafts through the holding means.

10. Apparatus according to claim 4, wherein the means to render the support non-rotatable comprises two parallel spaced shafts extending longitudinally of the guide means and slidably movable together through the holding means, the shafts being secured at each side of the holding means within two mountings, a longitudinally extending base to which both mountings are secured, the support being secured to the two mountings in a position downstream along the guide means from the holding means, a spring abutment on each shaft and compression springs,upon each shaft, the springs acting between the holding means and the abutments to urge the support away from the holding means, the initiating means axially fixed relative to the support.

11. Apparatus according to either claim 9 or 10 wherein the abutments are slidable upon the shafts, and means is provided to move the abutments upon the shafts to cause a resultant movement of the shafts through the holding means under the urgency of the spring, to adjust the position of the support away from the holding means.

12. Apparatus according to claim 11, wherein the means to move the abutments upon the shafts comprises a rotatable screw threaded spindle extending longitudinally of the shafts and extending in screw-threaded engagement through a hole in the abutments, the spindles received at one end in a mounting and the spindle being held in abutting relationship with the mounting by the spring urgency, the springs acting to apply their tension effect through the abutments, the spindle, the mounting and shafts and into the support.

13. Apparatus according to claim 1, wherein the initiating means comprises a magnetic switch means disposed adjacent to the guide means, and the trigger device comprises at least one magnetic field interrupter which is rotatable with a part of the guide means adjacent to the switch means, the switch means comprising means for creating a magnetic field and magnetic field strength receiving means by which an electrical signal is induced into an electrical circuit, the strength of the signal dependent upon the magnetic field strength received by the receiving means, the interrupter rotatable with said adjacent part of the guide means to pass through the magnetic field and change its field strength as received by the receiving means when the twisting means has rotated for its predetermined number of revolutions in one direction, and thus give a resultant change in electrical signal in the electrical circuit, the rotating means being operable upon such resultant change in signal to change the rotational direction of the twisting means.

14. Apparatus according to claim 13 wherein the direction changing means is disposed upstream so that the trigger device and adjacent part of the guide means rotate less than one complete revolution for the predetermined number of revolutions of the twisting means and the initiating means comprises two magnetic switch means, angularly disposed around the longitudinal axis of the guide means in fixed positions determined by the angular distance of movement of the magnetic field interrupter corresponding to the number of revolutions of the twisting means required to rotate from one directional change position to the other.

15. Apparatus according to claim 14, wherein in each magnetic switch means, the means for creating a magnetic field comprises a magnet and the receiving means comprises a conductive coil in the electrical circuit, the coil spaced from the magnet and placed in the magnetic field produced by the magnet, and the interrupter moves between the coil and magnet when the twisting means has rotated for its predetermined number of revolutions in one direction.

16. Apparatus according to claim 13 having a damping device to prevent the guide means from twisting uncontrollably by virtue of any stored twist in the guide means.

17. Apparatus according to claim 16, wherein the damping device comprises a torsion spring adjacent the interrupter, the spring having one part securely attached to non-rotatable means and another part rotatable with the guide means at the position of the spring, rotation of the guide means away from an untwisted equilibrium position being torsionally resisted by the spring.

* * * * *